US008091886B2

(12) United States Patent
Kato et al.

(10) Patent No.: US 8,091,886 B2
(45) Date of Patent: Jan. 10, 2012

(54) SHEET CONVEYING DEVICE AND IMAGE FORMING APPARATUS

(75) Inventors: Hitoshi Kato, Toride (JP); Naoki Ishikawa, Kashiwa (JP); Yasuo Fukatsu, Abiko (JP)

(73) Assignee: Canon Kabushiki Kaisha (JP)

( * ) Notice: Subject to any disclaimer, the term of this patent is extended or adjusted under 35 U.S.C. 154(b) by 90 days.

(21) Appl. No.: 12/476,209

(22) Filed: Jun. 1, 2009

(65) Prior Publication Data

US 2009/0295076 A1 Dec. 3, 2009

(30) Foreign Application Priority Data

Jun. 2, 2008 (JP) ..... 2008-144552

(51) Int. Cl.
*B65H 7/02* (2006.01)
*B65H 43/00* (2006.01)
*B65G 57/00* (2006.01)

(52) U.S. Cl. ..... 271/227; 271/228; 271/176; 414/791.2

(58) Field of Classification Search ..... 271/227, 271/228, 176; 414/791.2; 270/58.27; 399/371, 399/372, 404
See application file for complete search history.

(56) References Cited

U.S. PATENT DOCUMENTS

2009/0295076 A1* 12/2009 Kato et al. ..... 271/228
2009/0322012 A1* 12/2009 Ishikawa et al. ..... 271/9.01
2010/0225051 A1* 9/2010 Prabhat ..... 271/227
2010/0237558 A1* 9/2010 Prabhat et al. ..... 271/227

FOREIGN PATENT DOCUMENTS

JP 2005-156578 A 6/2005

* cited by examiner

*Primary Examiner* — David H Bollinger
(74) *Attorney, Agent, or Firm* — Rossi, Kimms & McDowell LLP

(57) ABSTRACT

A sheet conveying device which has a reduced size and is capable of detecting the amount of lateral sheet registration deviation and correcting the deviation at high speed. The sheet conveying device includes shift roller pairs for conveying sheets, and a shift unit for shifting a conveyed sheet in a direction orthogonal to a sheet conveying direction. After the sheet has reached a position where it is to be detected by a lateral registration deviation-detecting sensor unit, a CPU causes the sensor unit and the sheet to be shifted in respective opposite directions, detect a sheet lateral edge, and thereby measure the position of the sheet lateral edge. Further, the CPU causes the sheet to be shifted based on a result of the measurement, such that the sheet lateral edge is aligned with a predetermined position.

6 Claims, 17 Drawing Sheets

SHEET CONVEYING DEVICE AND IMAGE FORMING APPARATUS

BACKGROUND OF THE INVENTION

1. Field of the Invention

The present invention relates to a sheet conveying device which is capable of shifting sheets in a direction intersecting a sheet conveying direction, and an image forming apparatus including the sheet conveying device.

2. Description of the Related Art

Some recent image forming apparatuses have a number of optional units, such as a post-processing unit provided with a stapling function, a punching function, a saddle-stitching function, and like functions, and a large-capacity stacker, connected thereto to thereby construct an image forming system.

In a thus formed image forming system, mounting errors in joint sections between optional units and conveying paths increased in length tend to cause larger positional deviation of sheets (hereinafter referred to as "lateral registration deviation") in a direction (hereinafter referred to as "the lateral direction") intersecting a conveying direction than in a conventional image forming apparatus having no optional units connected thereto. The lateral registration deviation is increased particularly in an optional unit disposed at a location downstream, as viewed in the conveying direction, of the image forming apparatus.

Lateral registration deviation causes degradation of positional accuracy in stapling or punching, and hence lateral registration deviation is corrected in the post-processing unit. In order to correct the lateral registration deviation at a high speed, there has been proposed a technique in which the amount of lateral deviation in a conveying position (the amount of lateral registration deviation) is measured in advance, and the lateral registration deviation is corrected by shifting the sheet in the lateral direction while conveying the same.

In this technique, a sheet is shifted in the lateral direction in a state where a sheet shift distance required to correct lateral registration deviation has been grasped. Therefore, it is possible to shift the sheet at an optimal speed according to the sheet shift distance to thereby achieve high-speed correction of lateral registration deviation.

As a typical technique for measuring the amount of lateral deviation in the conveying position, there has been proposed a technique in which an optical transmissive sensor is shifted in the lateral direction, and the amount of lateral deviation in the conveying position is measured based on a distance from a point where the sensor starts to be shifted to a point where the sensor detects a lateral edge of a sheet (see Japanese Patent Laid-Open Publication No. 2005-156578). Further, there is also disclosed a technique for measuring the amount of lateral deviation in the conveying position using a line sensor.

The latter technique makes it possible to achieve high-speed measurement. However, the line sensor and a circuit for controlling the line sensor are very expensive, and hence the former technique is used in a larger number of products.

In the technique disclosed in Japanese Patent Laid-Open Publication No. 2005-156578, a standby position of the sensor is set such that a detecting point of the sensor corresponds to a lateral edge of a sheet conveyed without lateral registration deviation. Then, if the sensor is on at the start of measurement, it is shifted in a direction in which it is to turn off. On the other hand, if the sensor is off, it is shifted in a direction in which it is to turn on.

For example, if it is required to shift the sensor the sensor over a distance of 15 mm in the lateral direction, before the sensor is changed from a state in which a sheet is detected into a state in which the sheet is no longer detected, it is determined that the amount of lateral registration deviation is equal to 15 mm. This means that as the amount of lateral registration deviation is larger, it takes longer for measurement.

Meanwhile, it is demanded that an image forming apparatus be highly productive. With an increase in productivity, spacing (sheet interval) between the trailing edge of a preceding sheet and the leading edge of the following sheet is inevitably reduced, which makes it impossible to secure spacing required for performing post-processing, such as stapling or punching, on sheets. To solve this problem, in order to increase the spacing between a preceding sheet and a sheet following the sheet, it is required to increase the sheet conveying speed.

However, when the sheet conveying speed is increased, it is impossible to detect the amount of lateral sheet registration deviation while a sheet is passing the sensor.

Further, the downsizing of an image forming apparatus is demanded so as to reduce the installation area of the image forming apparatus. However, in a case where detection of the amount of lateral sheet registration deviation and the shifting of a sheet in the lateral direction are performed separately, as in the prior art, it is required to increase spacing in the sheet conveying direction between the sensor and a device for shifting a sheet in the lateral direction, which makes it difficult to reduce the size of the image forming apparatus.

SUMMARY OF THE INVENTION

The present invention provides a sheet conveying device which is capable of detecting the amount of lateral sheet registration deviation and correcting the lateral sheet registration deviation at a high speed, while being downsized, and an image forming apparatus including the sheet conveying device.

In a first aspect of the present invention, there is provided a sheet conveying device comprising a sheet conveying unit configured to convey a sheet, a sheet shifting unit configured to shift a sheet conveyed by the sheet conveying unit, in a lateral direction intersecting a sheet conveying direction in which the sheet is conveyed, a sheet detecting sensor configured to detect the sheet for being shifted by the sheet shifting unit, a sensor shifting unit configured to shift the sheet detecting sensor in the lateral direction, an edge position measurement unit configured to cause the sheet detecting sensor and the sheet to be shifted by the sensor shifting unit and the sheet shifting unit in respective opposite directions, and measure a position of the sheet edge based on an amount of shift of the sheet detecting sensor and an amount of shift of the sheet, which occur before a result of detection by the sheet detecting sensor changes, and an edge position control unit configured to cause the sheet to be shifted by the sheet shifting unit, based on a result of measurement by the edge position measurement unit, such that the sheet edge is aligned with a predetermined position in the lateral direction.

In a second aspect of the present invention, there is provided an image forming apparatus comprising an image forming section configured to form an image on a sheet, a sheet conveying unit configured to convey the sheet on which the image is formed, a sheet shifting unit configured to shift a sheet conveyed by the sheet conveying unit, in a lateral direction intersecting a sheet conveying direction in which the sheet is conveyed, a sheet detecting sensor configured to detect the sheet for being shifted by the sheet shifting unit, an edge position measurement unit configured to cause the sheet detecting sensor and the sheet to be shifted by the sensor shifting unit and the sheet shifting unit in respective opposite directions, and measure a position of the sheet edge based on an amount of shift of the sheet detecting sensor and an amount of shift of the sheet, which occur before a result of detection by the sheet detecting sensor changes, and an edge position control unit configured to cause the sheet to be shifted by the sheet shifting unit, based on a result of measurement by the edge position measurement unit, such that the sheet edge is aligned with a predetermined position in the lateral direction.

According to the present invention, it is possible to achieve the downsizing of the sheet conveying device as well as to detect the amount of lateral sheet registration deviation and correct the lateral sheet registration deviation at a high speed.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing a preferred embodiment thereof.

Figure 1:
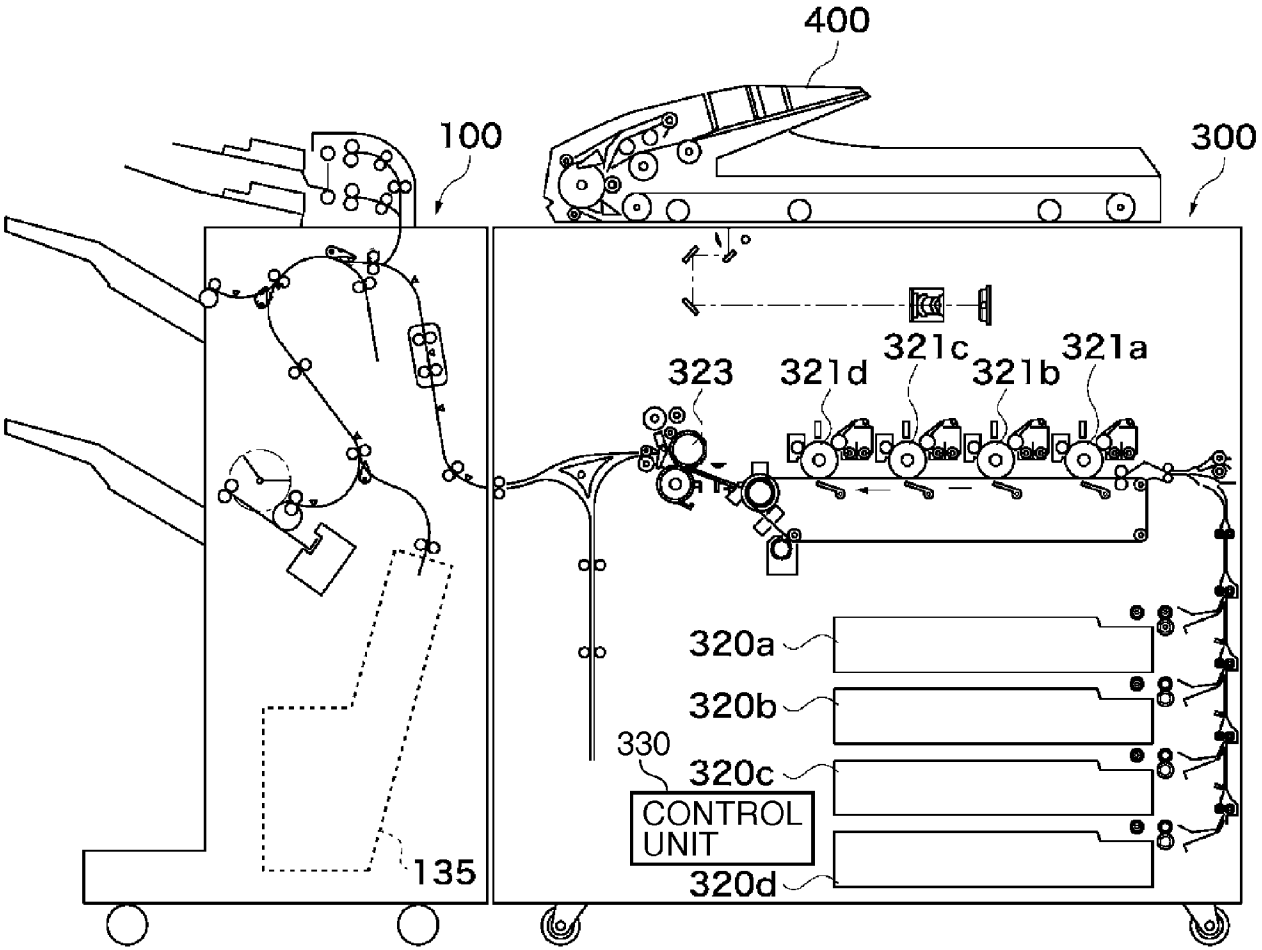
FIG. 1 is a view of an image forming apparatus according to an embodiment of the present invention.

FIG. 1 is a view of an image forming apparatus according to the embodiment of the present invention.

The present image forming apparatus is comprised of a main unit 300, a sheet processing unit 100, and an automatic document feeder 400.

The sheet processing unit 100 is connected to the main unit 300, and includes a saddle stitcher 135 and a side stitcher as a sheet stacking and processing unit. Therefore, sheets discharged from the main unit 300 can be subjected to post-processing online.

It should be noted that the sheet processing unit 100 is sometimes used as an optional unit. For this reason, the main unit 300 is configured such that it can be singly used as well. Further, the sheet processing unit 100 and the main unit 300 may be integrally formed.

A sheet fed from one of cassettes 320*a* to 320*d* is conveyed to yellow, magenta, cyan, and black image forming sections 321*a* to 321*d* as image forming units, and four color-toner images are superimposedly transferred onto the sheet by the respective image forming sections 321*a* to 321*d*. Then, the sheet is conveyed to a fixing device 323, and the full-color toner image is fixed on the sheet, followed by the sheet being discharged out of the apparatus.

The image forming apparatus is controlled by a control unit 330. The control unit 330 will be described in detail hereinafter with reference to FIG. 5.

Figure 2:
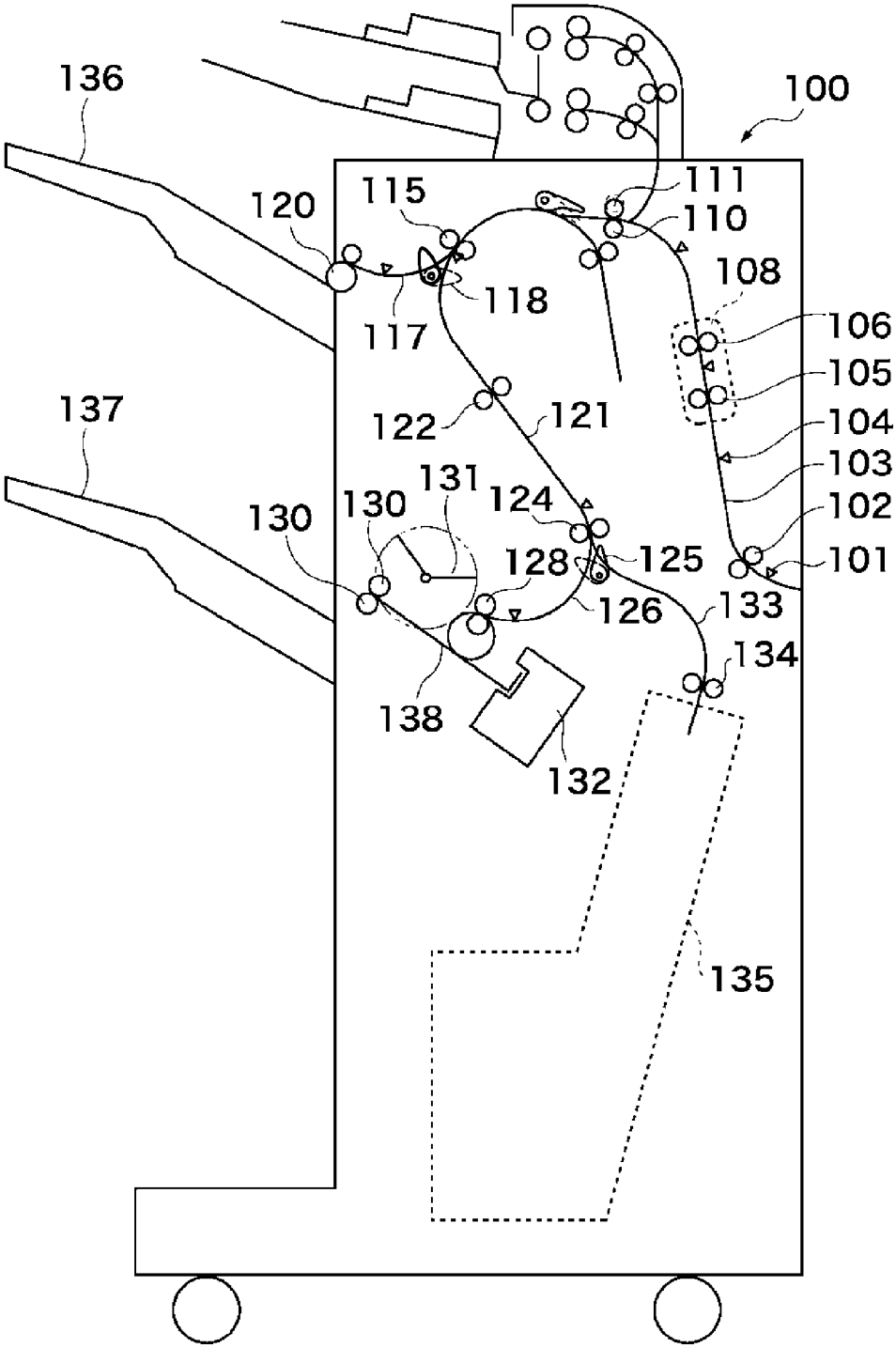
FIG. 2 is a view showing the details of a sheet processing unit.

FIG. 2 is a view showing the details of a sheet processing unit 100.

A description will be given of the arrangement of the sheet processing unit 100 together with its operation.

A sheet discharged from the main unit 300 is passed to an inlet roller pair 102 of the sheet processing unit 100. At this time, the sheet passing timing is detected by an inlet sensor 101.

The sheet conveyed by the inlet roller pair 102 has an edge position thereof in a lateral direction orthogonal to a sheet conveying direction detected by a lateral registration deviation-detecting sensor unit 104 while passing through a conveying path 103. More specifically, the lateral registration deviation-detecting sensor unit 104 detects how far the sheet deviates from a conveyance center position in the sheet processing unit 100. The amount of this deviation is referred to as the amount of lateral registration deviation. The conveyance center position corresponds to the center position, in the lateral direction, of a sheet conveyed without any registration deviation.

After the lateral registration deviation is detected by the lateral registration deviation-detecting sensor unit 104, a shift unit 108 is shifted in the lateral direction of the sheet by a predetermined amount while the sheet is being conveyed by shift roller pairs 105 and 106, whereby the sheet is subjected to a lateral shift operation.

The shift roller pairs 105 and 106 function as a sheet conveying unit. Further, the shift unit 108 is configured to move the shift roller pairs 105 and 106 in unison, and functions as a sheet shifting unit for shifting a sheet conveyed by the sheet conveying unit, in the lateral direction.

Thereafter, the sheet conveyed by a conveying roller 110 and a separation roller 111 is further conveyed by a buffer roller pair 115. Then, when the sheet is to be discharged onto an upper tray 136, an upper path-switching flapper 118 is brought into a state depicted in broken lines in FIG. 2, by a drive unit, not shown, such as a solenoid, whereby the sheet is guided into an upper conveying path 117. Then, the sheet is discharged onto the upper tray 136 by an upper discharge roller 120.

When the sheet is not to be discharged onto the upper tray 136, the sheet conveyed by the buffer roller pair 115 is guided into a bundle conveying path 121 by the upper path-switching flapper 118 in the state depicted in solid lines in FIG. 2. Thereafter, the sheet passes through the bundle conveying path 121 while being conveyed by a buffer roller pair 122 and a bundle conveying roller pair 124.

When performing saddle-stitching of sheets, a saddle path-switching flapper 125 is brought into a state depicted in broken lines in FIG. 2, by a drive unit, not shown, such as a solenoid. Then, the sheets are conveyed into a saddle path 133 to be guided into the saddle stitcher (saddle unit) 135 by a saddle inlet roller pair 134, followed by being saddle-stitched. Saddle-stitch processing is general processing, and is not an essential part of the present invention. Therefore, detailed description thereof is omitted.

When conveyed sheets are to be discharged onto a lower tray 137, the sheets conveyed by the bundle conveying roller pair 124 are guided into a lower path 126 by the saddle path-switching flapper 125 depicted in solid lines.

Thereafter, a predetermined number of the sheets discharged onto an intermediate processing tray 138 by a lower discharge roller pair 128 are aligned on the intermediate processing tray 138 by a return unit including a paddle 131 and a knurling belt (not shown). Then, the sheets are stapled, as required, by a stapler 132, and are thereafter discharged onto the lower tray 137 by a bundle discharge roller pair 130.

Next, a description will be given of the shift unit 108 as the sheet shifting unit for shifting a sheet in the lateral direction.

Figure 3:
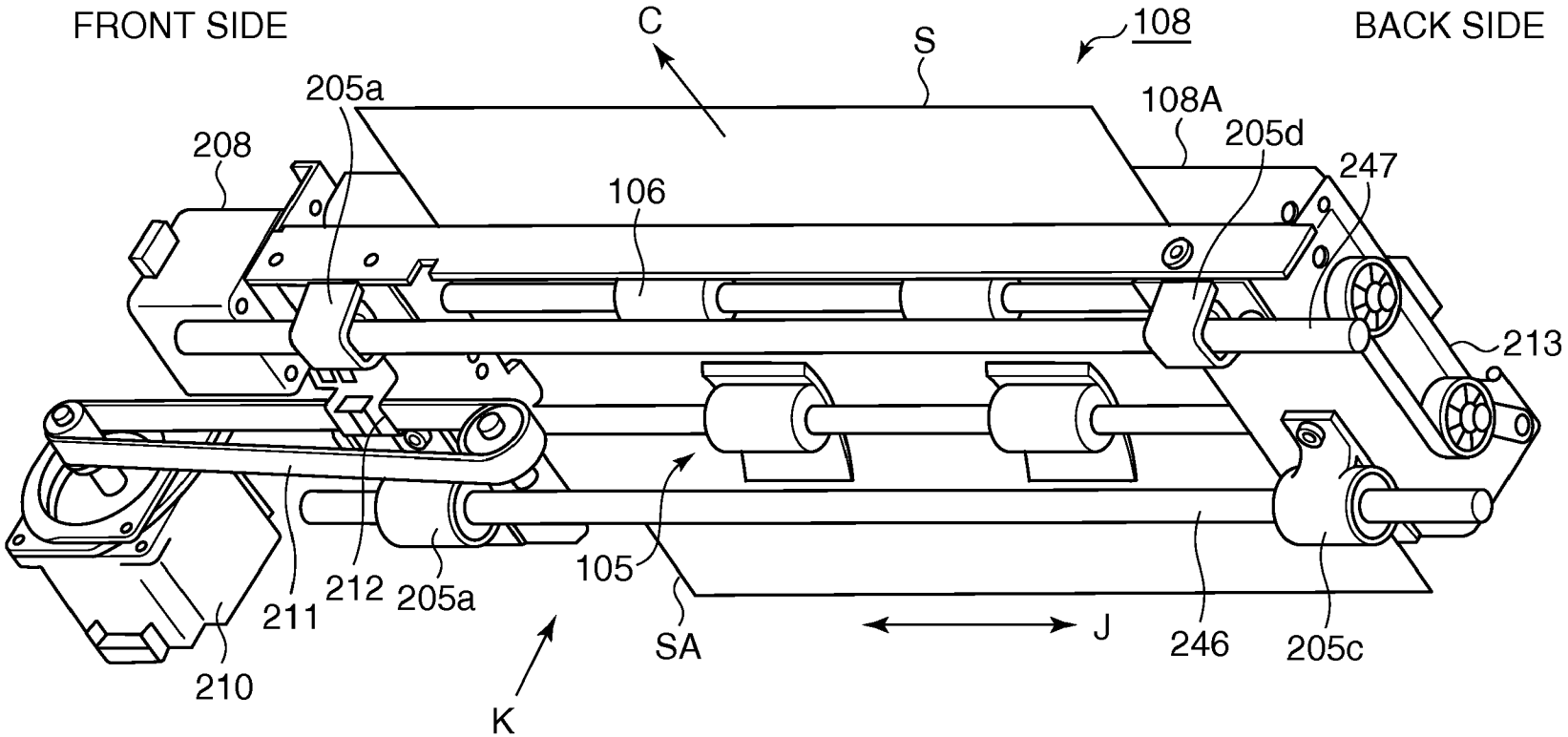
FIG. 3 is a perspective view of a shift unit.
Figure 4:
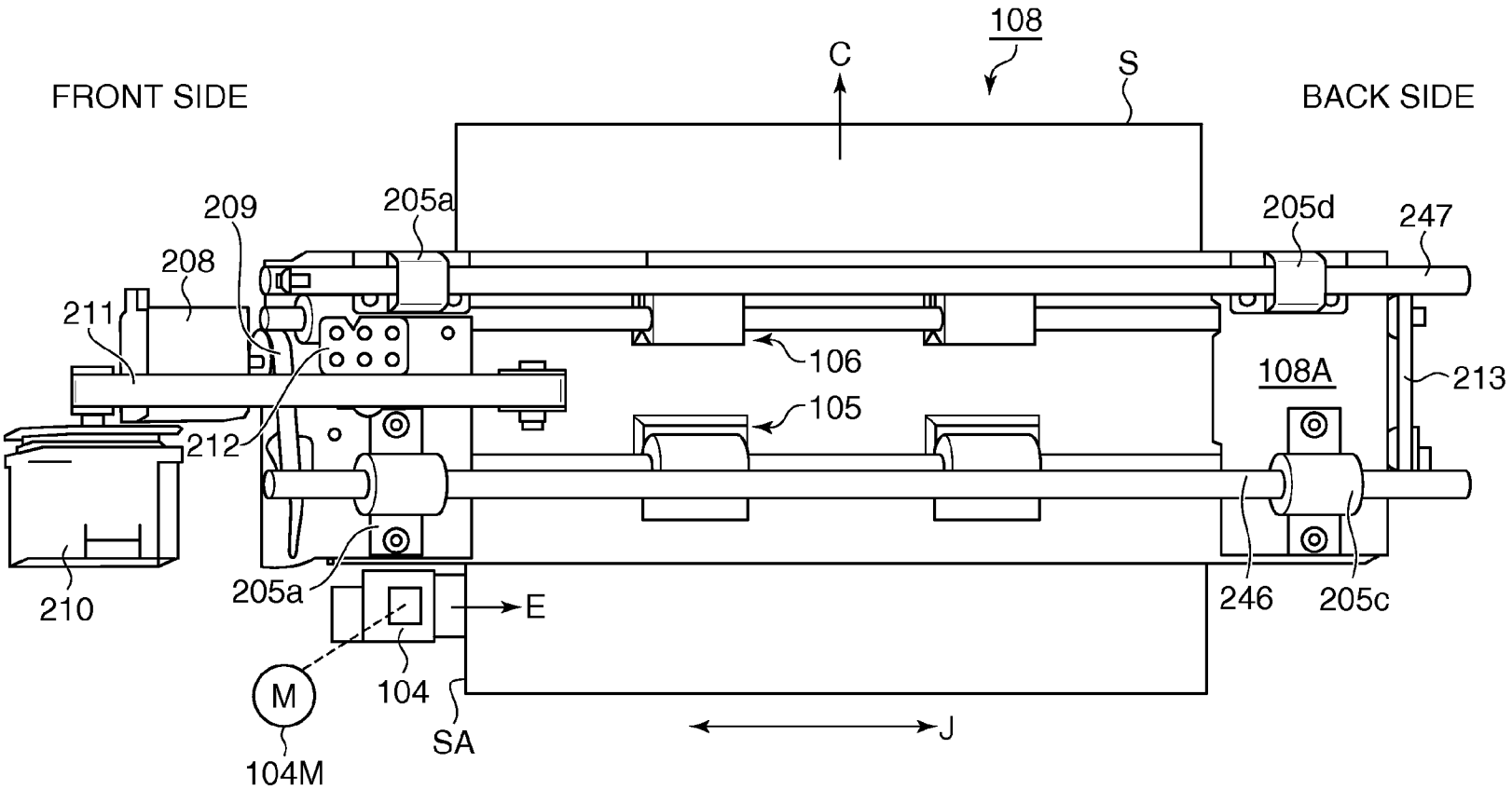
FIG. 4 is a view of the shift unit as viewed in a direction indicated by an arrow K in FIG. 3.

FIG. 3 is a perspective view of the shift unit 108 appearing in FIG. 2. FIG. 4 is a view of the shift unit 108 as viewed in a direction indicated by an arrow K in FIG. 3.

In FIGS. 3 and 4, as indicated therein, the right side of each figure corresponds to a back side of the sheet processing apparatus 100, and the left side of the same corresponds to a front side of the same.

A frame 108A of the shift unit 108 is supported by slide bushes 205*b* and 205*c* slidable on a slide rail 246, and slide bushes 205*a* and 205*d* slidable on a slide rail 247. The slide rails 246 and 247 are rigidly secured to the sheet processing unit 100.

The frame 108A can reciprocate along the slide rails 246 and 247 in directions indicated by a double-headed arrow J. The directions indicated by the arrow J are orthogonal to the sheet conveying direction, i.e. the directions indicated by the arrow J correspond to the lateral direction of a sheet S. An arrow C indicates the sheet conveying direction in which the sheet S is conveyed.

A shift conveying motor 208 and the shift roller pairs 105 and 106 are mounted to the frame 108A of the shift unit 108. The shift conveying motor 208 causes rotation of the shift roller pair 105 via a drive belt 209. Further, the shift roller pair 105 causes rotation of the shift roller pair 106 via a drive belt 213.

The sheet processing unit 100 is provided with the lateral registration deviation-detecting sensor unit 104 and a shift motor 210. When a signal for shifting the frame 10A is output from a sheet processing unit controller 310 described hereinafter, the shift motor 210 starts rotation to circulate a drive belt 211.

The drive belt 211 is connected to the frame 108A by a connecting member 212. Therefore, as the drive belt 211 is circulated, the frame 108A is shifted in the directions indicated by the arrow J. This shift of the frame 108A of the shift unit 108 in the directions indicated by the arrow J is caused while a sheet S is being nipped by the shift roller pairs 106 and 105.

The lateral registration deviation-detecting sensor unit 104 is configured to detect a lateral edge of a sheet S. The lateral registration deviation-detecting sensor unit 104 is shifted by a pulse motor 104M in a direction indicated by an arrow E. The arrow E indicates the same direction as the arrow J. The lateral registration deviation-detecting sensor unit 104 is disposed upstream of the shift unit 108 so as to calculate an amount of correction to be effected by the shift unit 108.

Next, a description will be given of the control unit 330 for controlling the overall operation of the image forming apparatus.

Figure 5:
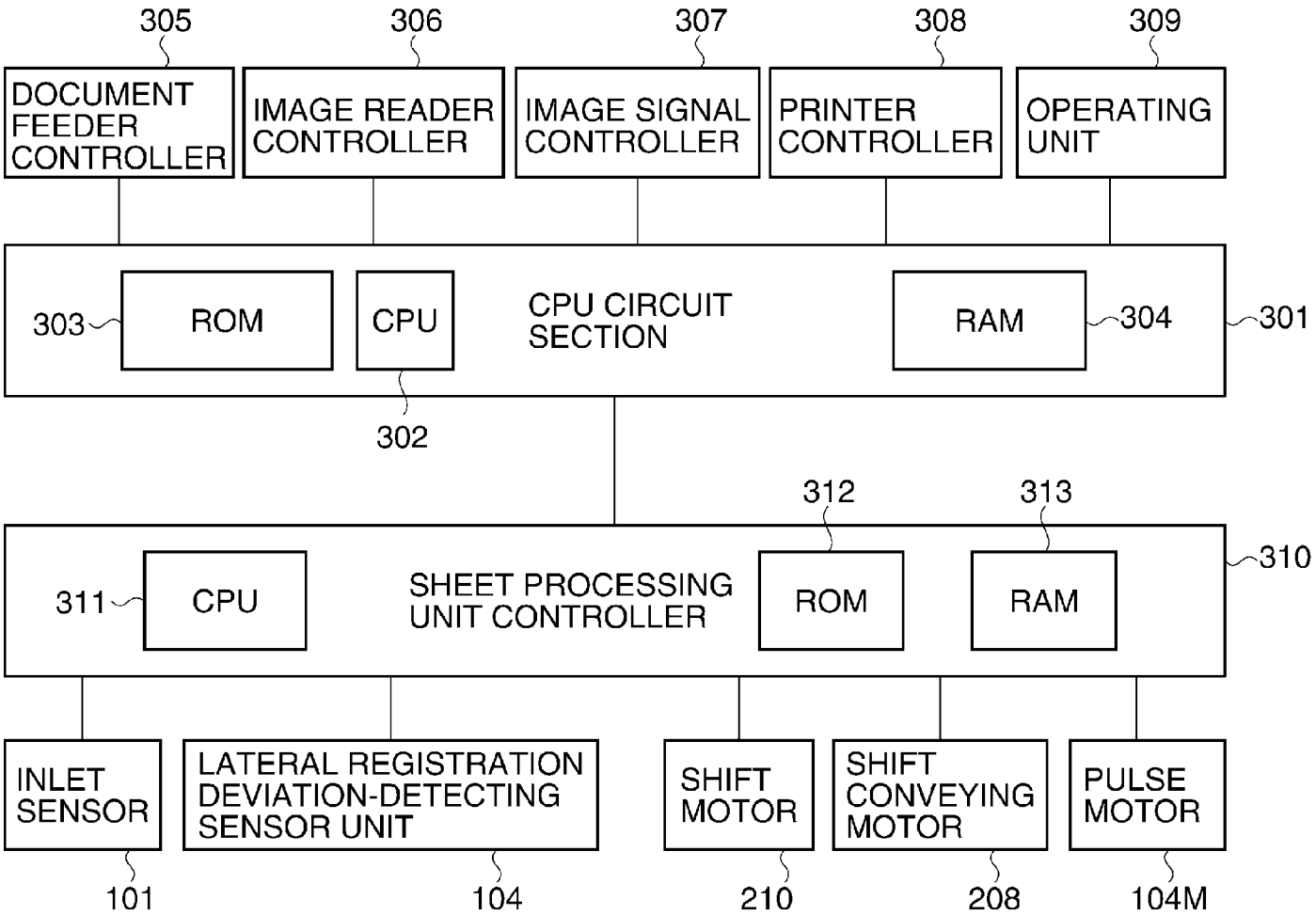
FIG. 5 is a control block diagram of a control unit.

FIG. 5 is a control block diagram of the control unit 330 appearing in FIG. 1.

As shown in FIG. 5, the control unit 330 is comprised of a CPU circuit section 301 and the sheet processing unit controller 310. Although in FIG. 1, the control unit 330 is incorporated in the main unit 300, in actuality, the sheet processing unit controller 310 thereof is incorporated in the sheet processing unit 100, as described hereinafter. However, the sheet processing unit controller 310 as well may be incorporated in the main unit 300.

The CPU circuit section 301 incorporates a CPU 302, and a ROM 303 and a RAM 304 as storage units. Blocks of the image forming apparatus are controlled in a centralized manner by a control program stored in the ROM 303.

More specifically, a document feeder controller 305, an image reader controller 306, an image signal controller 307, a printer controller 308, an operating unit 309, and the sheet processing unit controller 310 are controlled in a centralized manner by the control program.

The RAM 304 temporarily stores control data, and is also used as a work area for carrying out arithmetic operations involved in control processing.

The document feeder controller 305 drivingly controls the automatic document feeder 400 appearing in FIG. 1, based on an instruction from the CPU circuit section 301. The image reader controller 306 drivingly controls a light source, a lens system, and so forth, and transfers R, G, and B analog image signals output from, an image reading device, not shown, to the image signal controller 307.

The image signal controller 307 converts the R, G, and B analog image signals output from the image reader controller 306 into digital signals and then performs various kinds of processing on the digital signals. Further, the image signal controller 307 converts the processed digital signals into video signals, and then outputs the video signals to the printer controller 308. The processing operation by the image signal controller 307 is controlled by the CPU circuit section 301.

The operating unit 309 includes a plurality of keys for configuring various functions for image forming operation, and a display section for displaying information indicative of settings. Key signals corresponding to operations of the respective keys of the operating unit 309 are delivered to the CPU circuit section 301 functioning as a computing section and an input section. Further, the corresponding pieces of information are displayed e.g. on the display section of the operating unit 309, based on signals from the CPU circuit section 301.

The sheet processing unit controller 310 is incorporated in the sheet processing unit 100. The sheet processing unit controller 310 is capable of communicating information and data with the CPU circuit section 301 via a communication IC (IPC) (not shown) to thereby drivingly control the overall operation of the sheet processing unit 100.

The sheet processing unit controller 310 includes a CPU 311, a ROM 312, and a RAM 313.

Various actuators and sensors are controlled based on a control program stored in the ROM 312. For example, the inlet sensor 101 and the lateral registration deviation-detecting sensor unit 104 appearing in FIG. 2, the shift motor 210 and the shift conveying motor 208 appearing in FIG. 3, the pulse motor 104M for shifting the lateral registration deviation-detecting sensor unit 104, and so forth are controlled by the sheet processing unit controller 310. The RAM 313 temporarily stores control data, and is also used as a work area for carrying out arithmetic operations involved in control processing.

Figure 6:
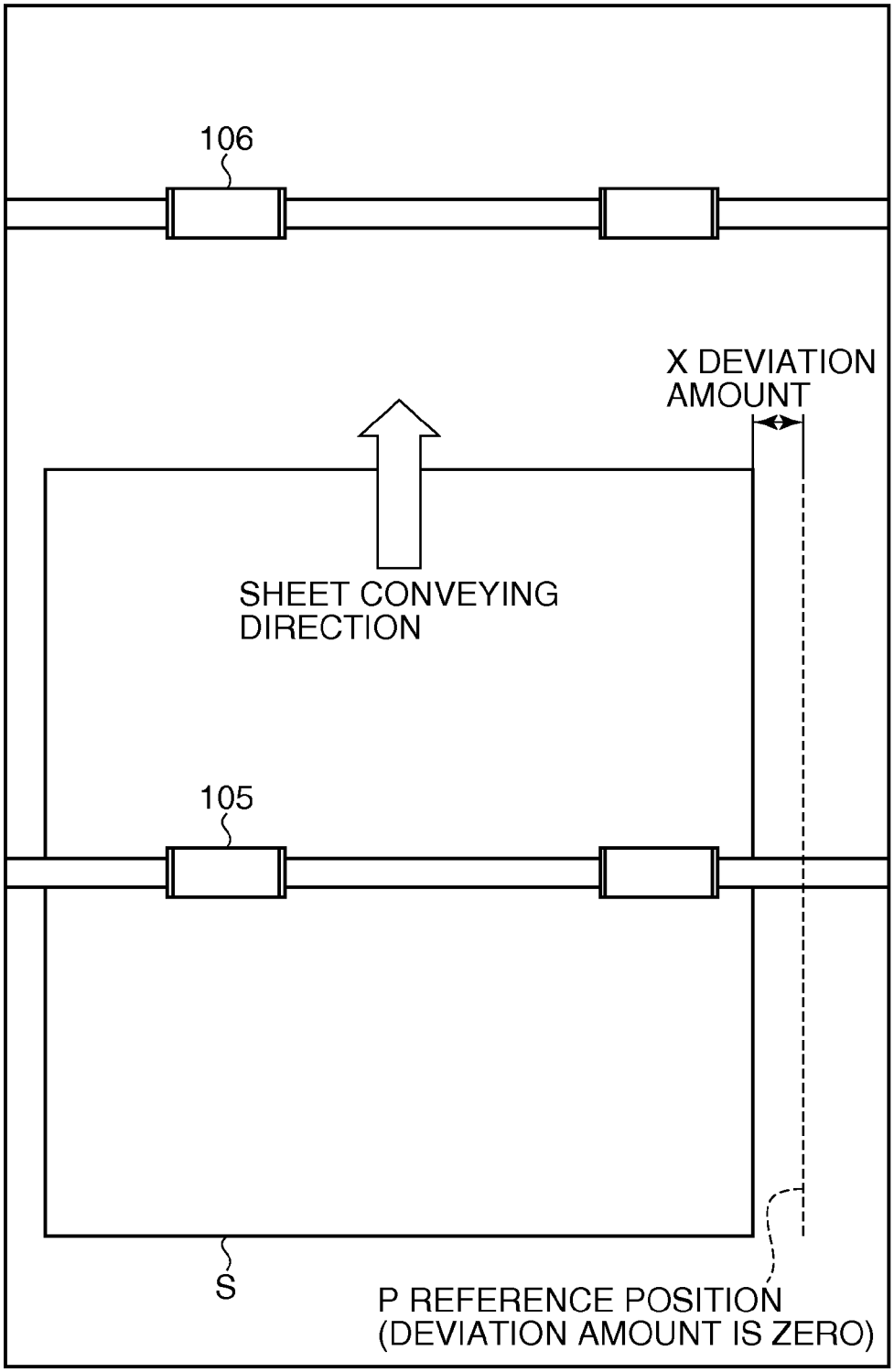
FIG. 6 is a view useful in explaining a lateral registration deviation which occurs during sheet conveyance in the sheet processing unit.

FIG. 6 is a view useful in explaining a lateral registration deviation which occurs during sheet conveyance in the sheet processing unit 100 shown in FIG. 2.

As shown in FIG. 6, a sheet is sometimes conveyed into the sheet processing unit 100 in a state shifted in the lateral direction by a distance X (deviation amount X) from a reference position P indicative of a sheet end position without any lateral registration deviation. The deviation amount X of lateral deviation of a sheet end position from the reference position P is detected by the lateral registration deviation-detecting sensor unit 104.

Figure 7:
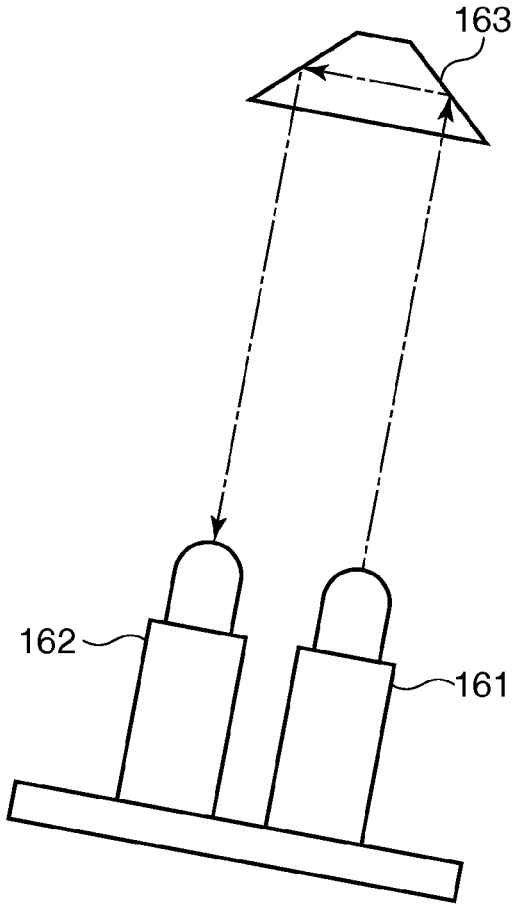
FIG. 7 is a view of a lateral registration deviation-detecting sensor unit.

FIG. 7 is a view of the lateral registration deviation-detecting sensor unit 104 appearing in FIG. 2.

As shown in FIG. 7, the lateral registration deviation-detecting sensor unit 104 as a sheet detecting sensor is comprised of an LED 161, a phototransistor 162, and a prism 163. As indicated by arrows, light emitted from the LED 161 is reflected by the prism 163 to enter the phototransistor 162.

When a sheet is positioned between the prism 163, and the LED 161 and the phototransistor 162, the light is blocked by the sheet, so that the light cannot enter the phototransistor 162. Thus, the presence or absence of a sheet is detected based on whether or not the phototransistor 162 has received light.

In the present embodiment, the lateral registration deviation-detecting sensor unit 104 is configured to be on when a sheet is being detected, and be off when no sheet is being detected.

The lateral registration deviation-detecting sensor unit 104 is capable of being shifted in the lateral direction of a sheet by the pulse motor 104M serving as a sheet detecting/shifting unit. Detection of the sheet is performed while shifting the lateral registration deviation-detecting sensor unit 104, whereby an edge of the sheet (SA in FIGS. 3 and 4) parallel with the sheet conveying direction is detected.

Next, a description will be given of measurement of the lateral edge position of a sheet.

Figure 8:
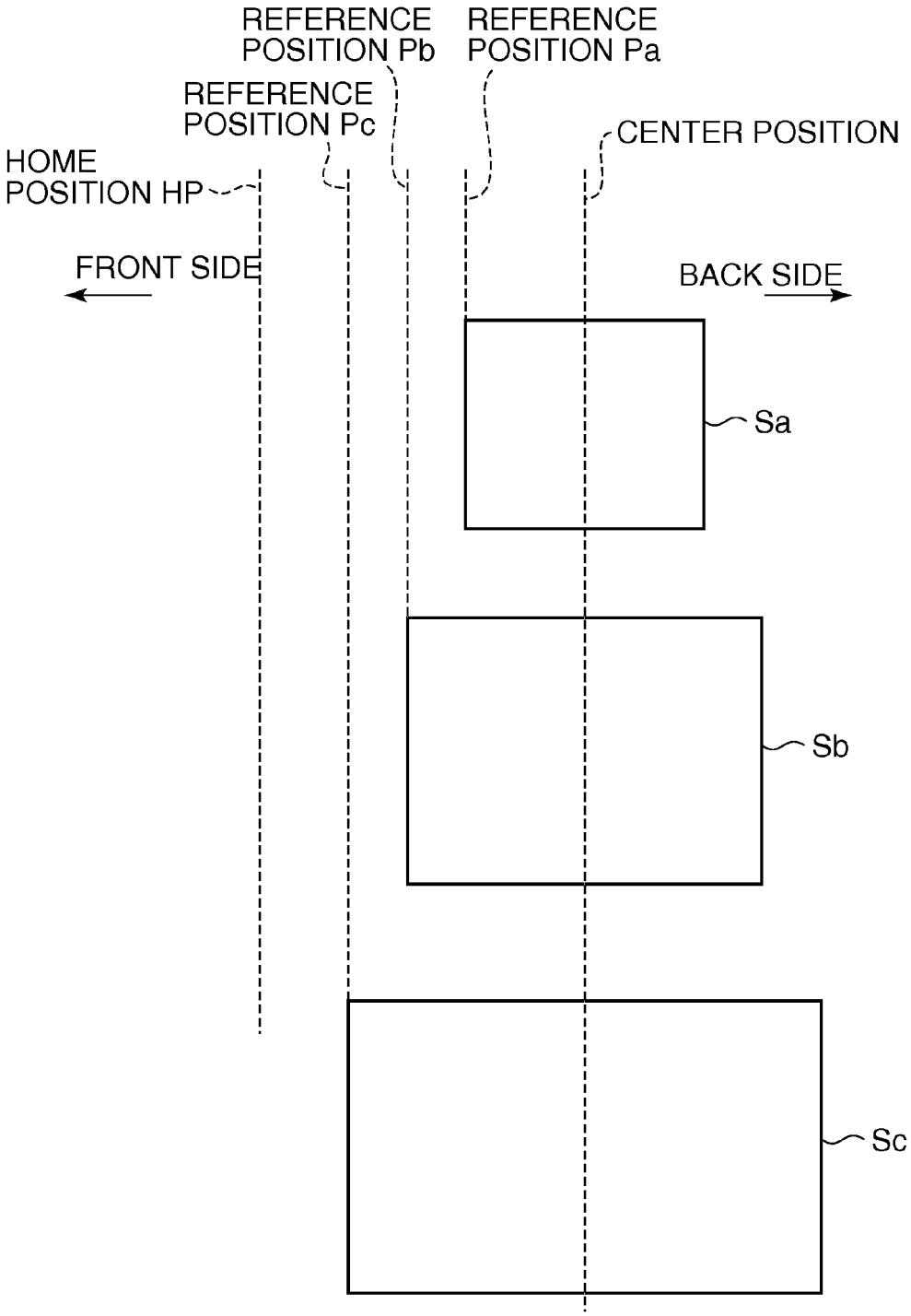
FIG. 8 is a view showing the relationship between the size of a sheet conveyed within the sheet processing unit and a reference position.

FIG. 8 is a view showing the relationship between the size of a sheet conveyed within the sheet processing unit 100 and an associated reference position. Assuming that FIG. 1 shows the image forming apparatus as viewed from the front thereof, a side of a sheet toward a viewer viewing FIG. 1 corresponds to a front side of the image forming apparatus, and a side of the same remote from the viewer corresponds to a back side of the same. In short, the opposite sides of a sheet toward and remote from the viewer correspond to the front and back sides of the apparatus in the lateral direction of the sheet, respectively.

When sheet conveyance is not performed in the sheet processing unit, the lateral registration deviation-detecting sensor unit 104 is kept on standby at its home position HP. When sheet conveyance is started, the lateral registration deviation-detecting sensor unit 104 is shifted by the pulse motor 104M to a reference position P (one of positions Pa to Pc corresponding to respective sheet sizes). Then, the lateral registration deviation-detecting sensor unit 104 is kept on standby at the reference position P until a sheet S reaches the position.

The home position HP corresponds to a position where the lateral registration deviation-detecting sensor unit 104 is disposed when a lateral registration deviation-detecting sensor unit HP sensor, not shown, is on. The lateral position of the lateral registration deviation-detecting sensor unit 104 is controlled with reference to the home position HP detected by the lateral registration deviation-detecting sensor unit HP sensor.

The reference position P corresponds to a position of a lateral edge of the sheet S without any lateral deviation and is determined in advance according to the lateral size of each sheet. The reference position P for use in the control is determined based on sheet information delivered to the control unit 330 before the start of conveyance of the sheet.

As shown in FIG. 8, as the width of a conveyed sheet S (Sa, Sb, or Sc) is larger, the reference position P (Pa, Pb, or Pc) comes closer to the home position P from the center position. A distance as determined from the home position HP of the lateral registration deviation-detecting sensor unit 104 to the reference position P is calculated by the CPU 311 of the sheet processing unit controller 310, and the lateral registration deviation-detecting sensor unit 104 is shifted to the reference position P by the pulse motor 104M.

When the conveyed sheet S reaches the lateral registration deviation-detecting sensor unit 104, first, the sheet processing unit 100 detects whether or not the sheet S is present using the lateral registration deviation-detecting sensor unit 104.

Figure 9:
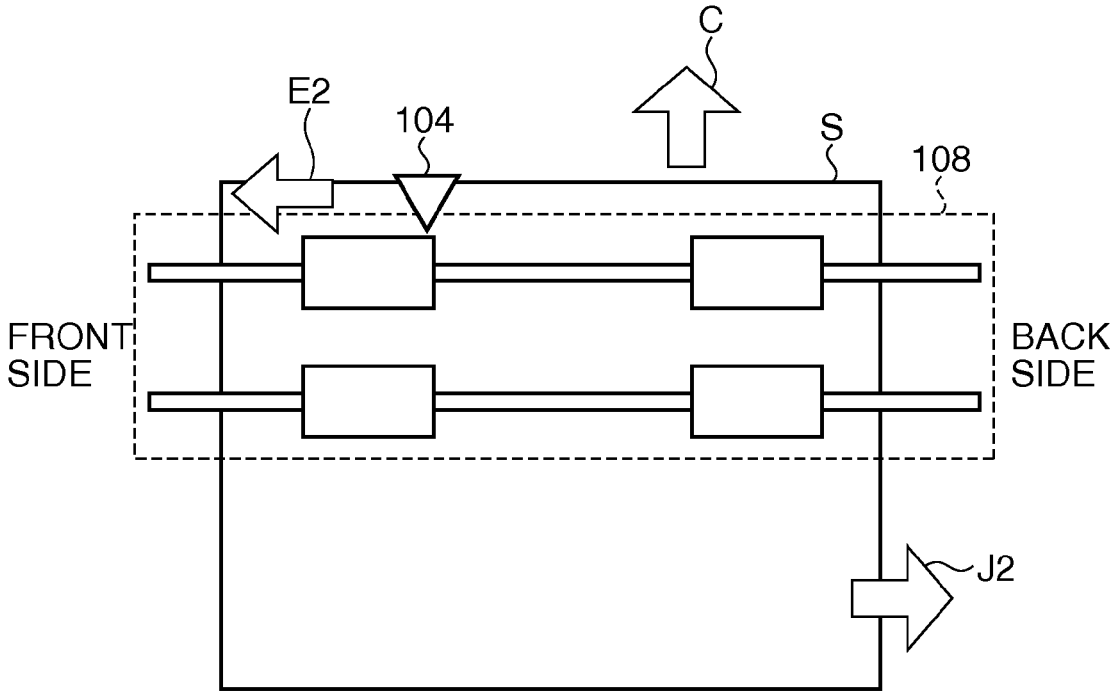
FIG. 9 is a view of a state in which the lateral registration deviation-detecting sensor unit has detected the presence of a sheet.
Figure 10:
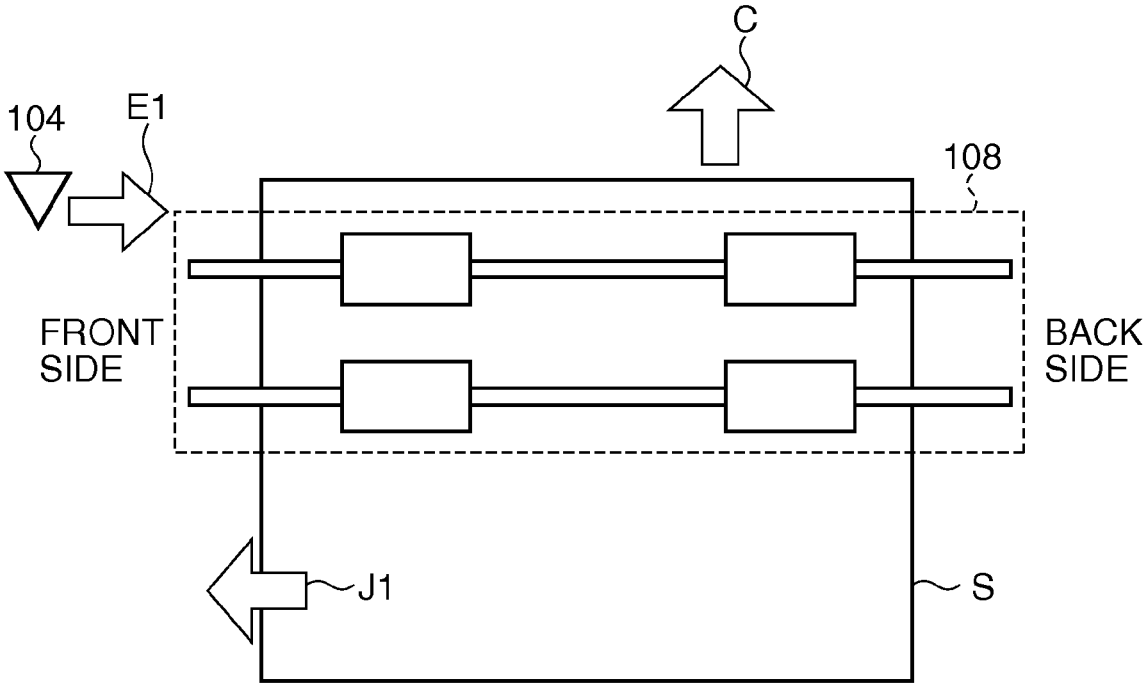
FIG. 10 is a view of a state in which the lateral registration deviation-detecting sensor unit has detected the absence of a sheet.

FIG. 9 is a view of a state of the lateral registration deviation-detecting sensor unit 104 appearing in FIG. 2 in which it is detecting the presence of a sheet. FIG. 10 is a view of a state of the lateral registration deviation-detecting sensor unit 104 appearing in FIG. 2 in which it is detecting the absence of a sheet.

As shown in FIG. 9, when the lateral registration deviation-detecting sensor unit 104 detects a sheet S, the sheet processing unit 100 causes the lateral registration deviation-detecting sensor unit 104 to be shifted frontward (i.e. in a direction indicated by an arrow E2), as viewed from the front of the sheet processing unit 100, by the pulse motor 104M. At the same time, the sheet S is shifted backward (i.e. in a direction indicated by an arrow J2) by the shift unit 108. An arrow C in FIG. 9 indicates the sheet conveying direction.

On the other side, when the lateral registration deviation-detecting sensor unit 104 does not detect the sheet S as shown in FIG. 10, the sheet processing unit 100 causes the lateral registration deviation-detecting sensor unit 104 to be shifted backward (i.e. in a direction indicated by an arrow E1), and at the same time the sheet S is shifted frontward (i.e. in a direction indicated by an arrow J1).

Thus, the sheet processing unit 100 causes the sheet and the sensor to be shifted in respective opposite directions, whereby the amount of lateral deviation of the sheet in the conveying position is calculated based on a distance over which the lateral registration deviation-detecting sensor unit 104 is shifted from the reference position P and a distance over which the sheet is shifted before the lateral registration deviation-detecting sensor unit 104 detects the lateral edge of the sheet.

The deviation amount X of lateral deviation in the conveying position of the sheet can be calculated as follows:

Let it be assumed that the amount of advance of the lateral registration deviation-detecting sensor unit 104 per one pulse supplied to the pulse motor 104M is represented by b, and the number of pulses required to be supplied to the pulse motor 104M to shift the lateral registration deviation-detecting sensor unit 104 from the reference position P before the lateral edge of the sheet is detected is represented by p. Further, let it be assumed that the amount of advance of the shift unit 108 per one pulse supplied to the shift motor 210 is represented by c, and the number of pulses required to be supplied to the shift motor 210 before the lateral edge of the sheet is detected is represented by q. In this case, the deviation amount X is expressed by the following equation (1):

$$X=b\times p+c\times q \quad (1)$$

After detecting the lateral edge of the sheet, the lateral registration deviation-detecting sensor unit 104 is returned to the reference position P and is kept on standby until a next sheet arrives. On the other hand, the shift unit 108 laterally shifts the sheet to a target position based on the calculated deviation amount X of lateral deviation in the conveying position of the sheet (amount of lateral deviation of the position of the lateral edge of the sheet). The target position corresponds, in this example, to a position where the lateral edge of the sheet is to be aligned with the reference position P.

The lateral registration deviation-detecting sensor unit 104 can be implemented by any suitable sensor, insofar as it is capable of detecting a sheet edge. For example, a plurality of transmissive or reflective sensors using no prism may be arranged to detect the sheet edge based on the state of transmission/reflection of light. Further, the sensor is not limited to an optical sensor, but a mechanical sensor capable of mechanically detecting the lateral edge of a sheet may be employed.

Next, a lateral registration deviation-correcting process for correcting the lateral deviation in the conveying position of the sheet (lateral registration deviation) will be described with reference to a flowchart shown in FIGS. 11A and 11B.

Figure 11A:
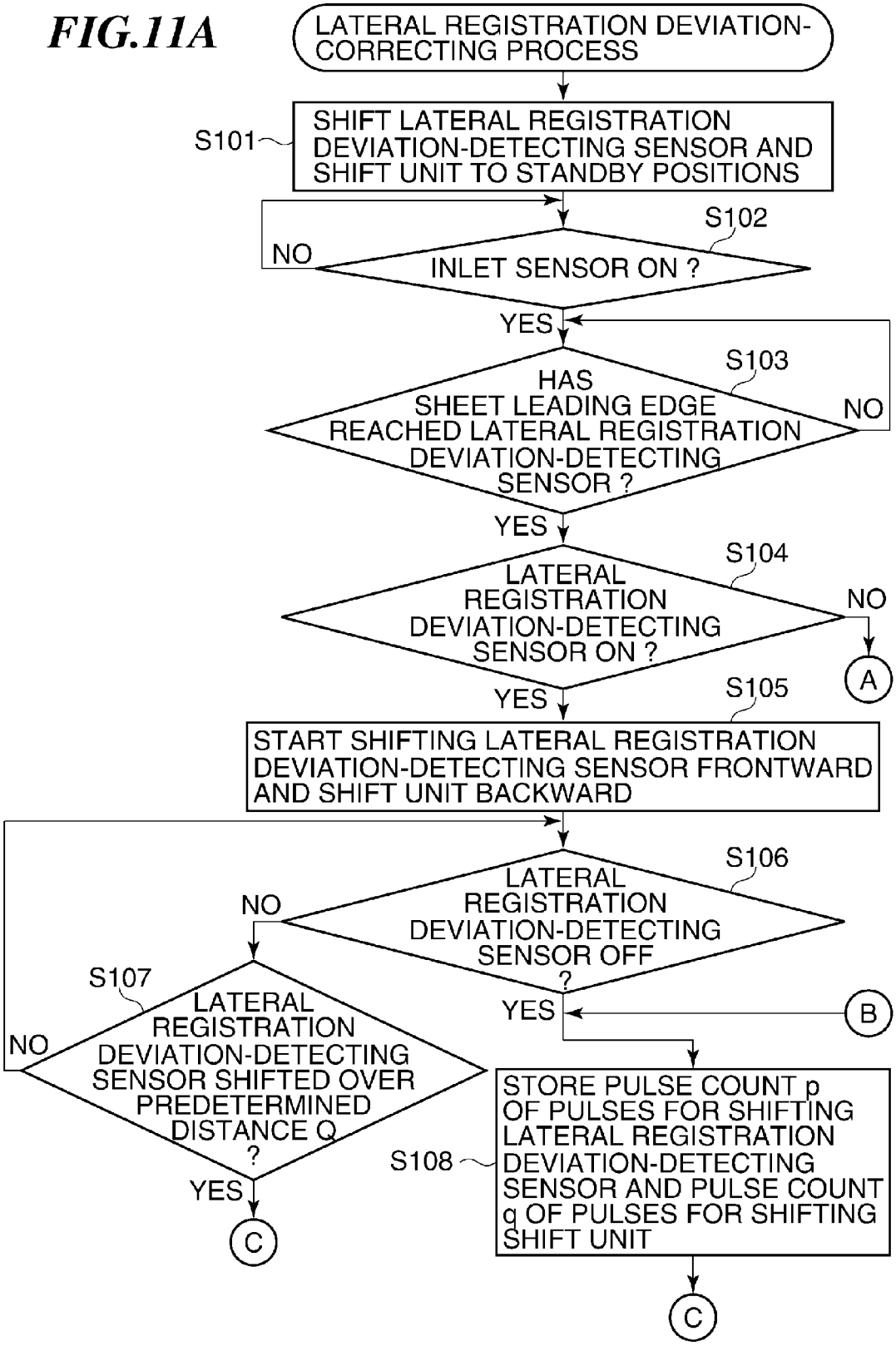
FIGS. 11A and 11B show a flowchart of a lateral registration deviation-correcting process executed by a sheet processing unit controller.
Figure 11B:
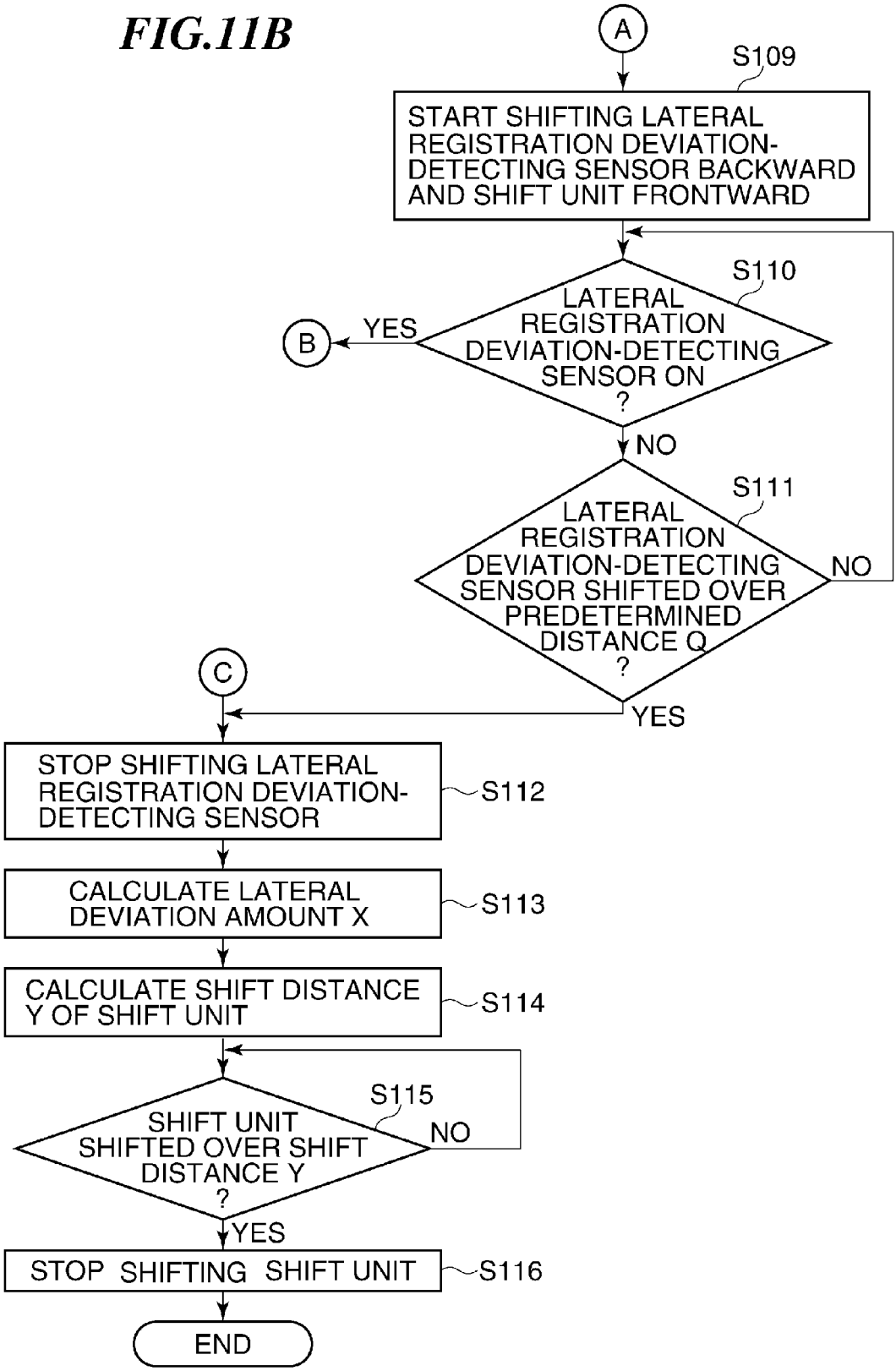

FIGS. 11A and 11B show the flowchart of the lateral registration deviation-correcting process executed by the sheet processing unit controller 310.

When a start button of the operating unit 308 is pressed to start a job, the lateral registration deviation-correcting process is executed by the CPU 311 of the sheet processing unit controller 310.

First in a step S101, the CPU 311 causes the lateral registration deviation-detecting sensor unit 104 (hereinafter simply referred to as "the lateral registration-detecting sensor) to be shifted by the pulse motor 104M such that the detection point of the lateral registration-detecting sensor 104 is aligned with the reference position P. Further, the CPU 311 causes the shift unit 108 to be shifted by the shift motor 210 to the center position (FIG. 8) in the lateral direction. The reference position P is determined based on sheet size information delivered from the CPU circuit section 301 upon the start of the job.

Then, in a step S102, the CPU 311 determines whether or not the inlet sensor 101 has been turned on. If the inlet sensor 101 has been turned on, it is determined whether or not the leading edge of the sheet has reached the lateral registration-detecting sensor 104 (step S103). More specifically, at a time point when a sheet conveying distance calculated based on a time period elapsed after turn-on of the inlet sensor 101 and a sheet conveying speed becomes equal to a distance from the inlet sensor 101 to the lateral registration-detecting sensor 104, the CPU 311 determines that the leading edge of the sheet has reached the lateral registration-detecting sensor 104.

If it is determined in the step S103 that the leading edge of the sheet has reached the lateral registration-detecting sensor 104, the CPU 311 determines whether or not the lateral registration-detecting sensor 104 is on (step S104). In the present embodiment, the on state of the lateral registration-detecting sensor 104 indicates the presence of a sheet, whereas the off state of the same indicates the absence of the sheet.

If it is determined in the step S104 that the lateral registration-detecting sensor 104 is on, the CPU 311 causes the lateral registration-detecting sensor 104 to be shifted in the direction indicated by the arrow E2 in FIG. 9 and the shift unit 108 to be shifted in the direction indicated by the arrow J2 (step S105).

Then, the CPU 311 determines whether or not the lateral registration-detecting sensor 104 has been turned off (step S106). If the lateral registration-detecting sensor 104 has been turned off, the CPU 311 stores in the RAM 313 a pulse count p indicative of the number of pulses supplied to the pulse motor 104M for shifting the lateral registration-detecting sensor 104, which is counted until the turn-off of the lateral registration-detecting sensor 104 and a pulse count q indicative of the number of pulses supplied to the shift motor 210 for shifting the shift unit 108, which is counted until the turn-off of the lateral registration-detecting sensor 104 (step S108).

On the other hand, if it is determined in the step S106 that the lateral registration-detecting sensor 104 has not been turned off, the CPU 311 determines whether or not the lateral registration-detecting sensor 104 has been shifted over a predetermined distance Q (step S107). If the lateral registration-detecting sensor 104 has not been shifted over the predetermined distance Q, the process returns to the step S106. The predetermined distance Q corresponds to a maximum distance over which the shift unit 108 can shift.

On the other hand, if it is determined in the step S104 that the lateral registration-detecting sensor 104 is off, the CPU 311 causes the lateral registration-detecting sensor 104 to be shifted in the direction indicated by the arrow E1 in FIG. 10 and the shift unit 108 to be shifted in the direction indicated by the arrow J1 in FIG. 10 (step S109).

Then, the CPU 311 determines whether or not the lateral registration-detecting sensor 104 has been turned on (step S110). If the lateral registration-detecting sensor 104 has been turned on, the CPU 311 stores in the RAM 313 the pulse count p of pulses supplied for shifting the lateral registration-detecting sensor 104 and the pulse count q of pulses supplied for shifting the shift unit 108 each counted before the turn-on of the lateral registration-detecting sensor 104 (step S108).

On the other hand, if it is determined in the step S110 that the lateral registration-detecting sensor 104 has not been turned on, the CPU 311 determines whether or not the lateral registration-detecting sensor 104 has been shifted over the predetermined distance Q (step S111). If the lateral registration-detecting sensor 104 has not been shifted over the predetermined distance Q, the process returns to the step S110.

When the processing in the step S108 is completed or when it is determined in the step S107 or S111 that the lateral registration-detecting sensor 104 has been shifted over the predetermined distance Q, the shifting of the lateral registration-detecting sensor 104 is stopped (step S112).

Then, the deviation amount X of lateral deviation in the conveying position of the sheet is calculated by the aforementioned equation (1) (step S113). It should be noted that when the lateral registration-detecting sensor 104 has been shifted over the predetermined distance Q, the CPU 311 determines that the deviation amount X of lateral deviation in the conveying position of the sheet is equal to a maximum value (predetermined value).

In short, the CPU 311 functions as an edge position measurement unit that is configured to shift the sheet detecting sensor and a sheet in the respective opposite directions and detect the edge of the sheet in the lateral direction, to thereby measure the position of the sheet edge.

Next, the CPU 311 calculates a shift distance Y over which the shift unit 108 is to be shifted (step S114). The shift distance Y is obtained by subtracting a distance over which the shift unit 108 has already been shifted during the deviation amount measurement from the measured deviation amount X of lateral deviation in the conveying position of the sheet.

Then, the CPU 311 awaits completion of the shift of the shift unit 108 over the shift distance Y (step S1 is). When the shift unit 108 has been shifted over the shift distance Y, the CPU 311 causes the shift unit 108 (step S116) to be stopped, followed by terminating the lateral registration deviation-correcting process.

In short, the CPU 311 functions as an edge position control unit that is configured to shift a sheet by the sheet shifting unit, based on a result of measurement by the edge position measurement unit, such that the lateral edge of the sheet is aligned with a predetermined position.

Next, a description will be given of a lateral registration deviation-correcting process for correcting the lateral deviation in the conveying direction of a sheet when the sheet processing unit 100 is set to a sheet offset mode, with reference to a flowchart shown in FIGS. 12A to 12C.

Figure 12A:
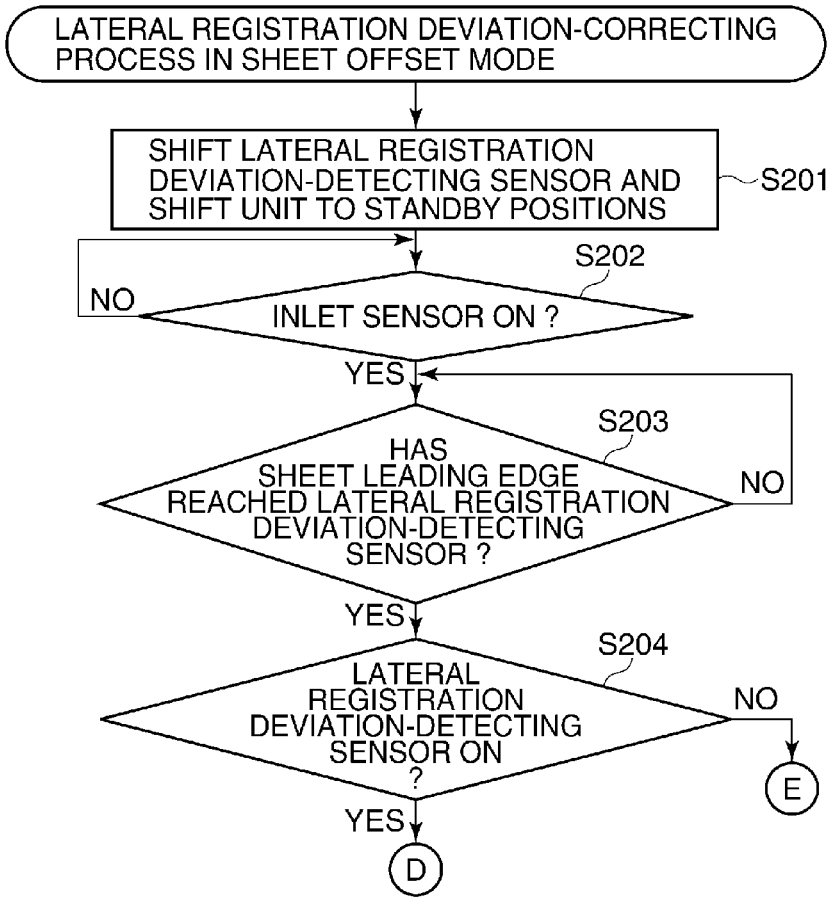
FIGS. 12A to 12C show a flowchart of a lateral registration deviation-correcting process executed by the sheet processing unit controller when the sheet processing unit is set to a sheet offset mode.
Figure 12B:
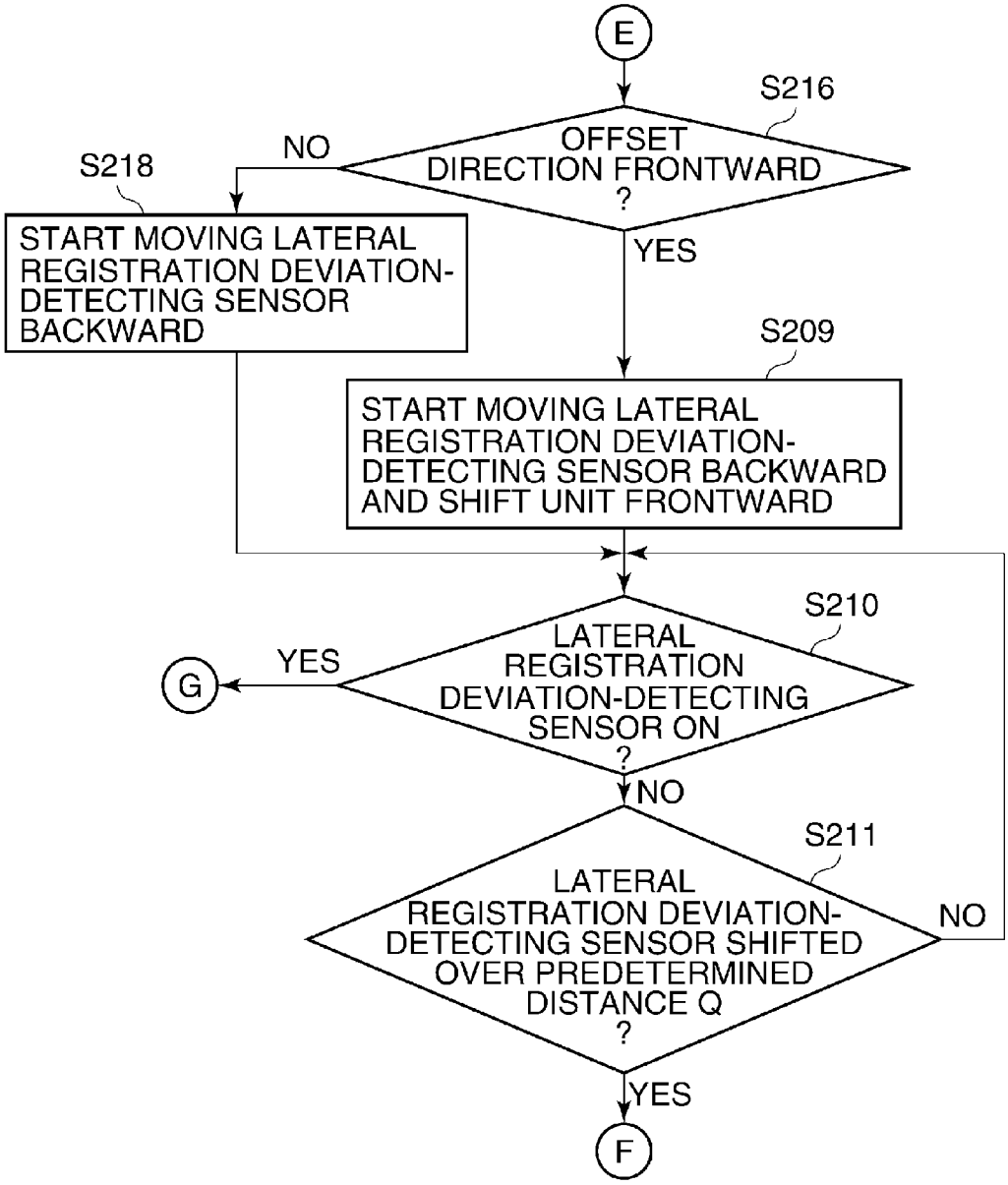
Figure 12C:
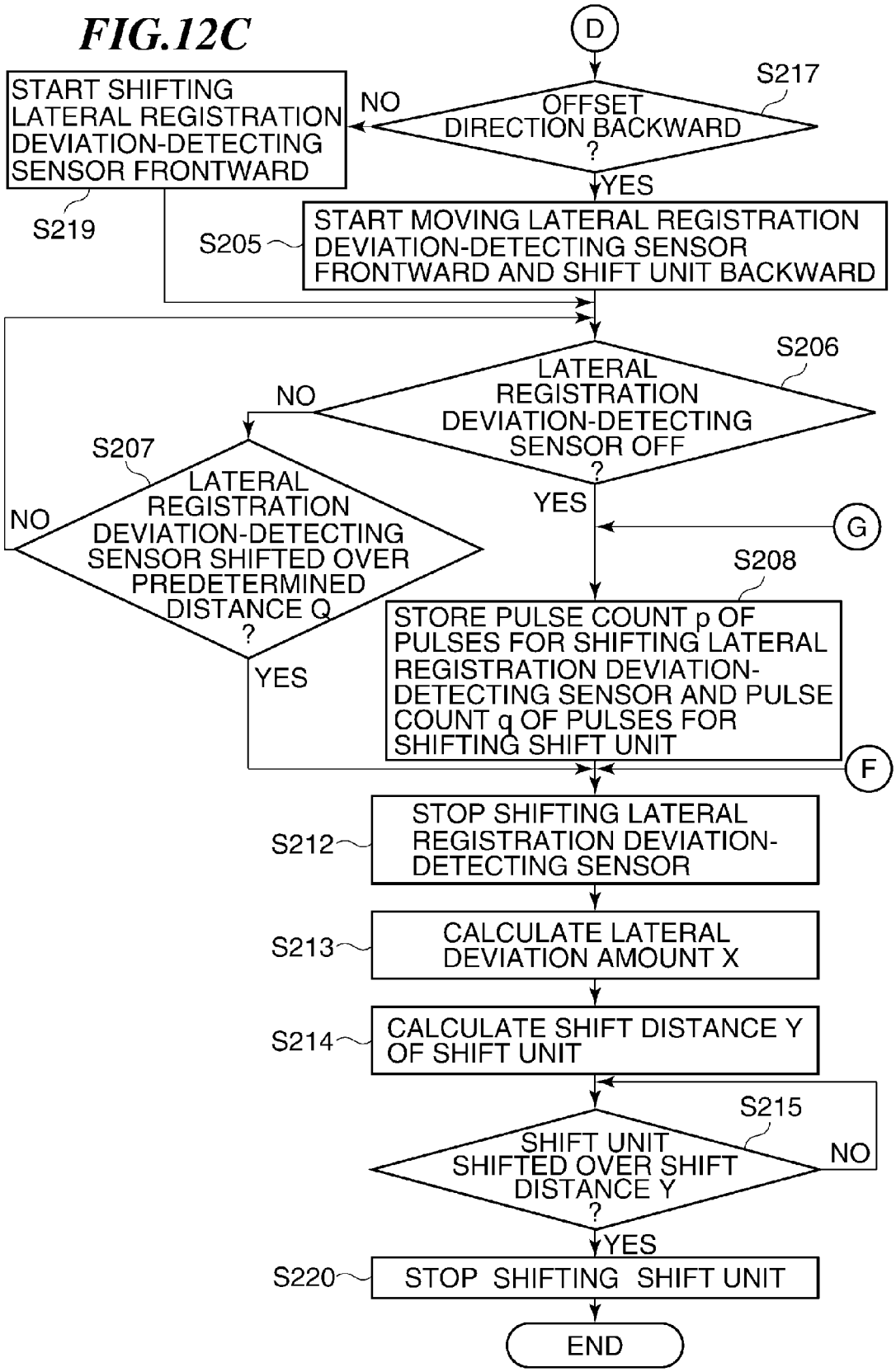

FIGS. 12A to 12C show the flowchart of the lateral registration deviation-correcting process executed by the CPU 311 of the sheet processing unit controller 310 appearing in FIG. 5 when the sheet processing unit 100 is set to the sheet offset mode.

When the start button of the operating unit 308 is pressed to start a print job, the lateral registration deviation-correcting process is executed by the CPU 311 of the sheet processing unit controller 310. This lateral registration deviation-correcting process is distinguished from the lateral registration deviation-correcting process shown in FIGS. 11A and 11B in that there is provided a step for determining an offset direction, and process is executed in accordance with results of this determination.

First, steps S201 to S204 are identical to the steps S101 and S104 in FIG. 11A.

If it is determined in the step S204 that the lateral registration-detecting sensor 104 is on, the CPU 311 determines whether or not the offset direction of the sheet is backward (step S217). The offset direction means a direction in which the sheet is to be laterally shifted in the sheet offset mode for laterally offsetting a sheet discharge position. Further, the backward direction of the offset direction is intended to mean the same direction as indicated by the arrow J2 in FIG. 9, and the frontward direction of the offset direction is intended to mean the same direction as indicated by the arrow J2 in FIG. 9.

If it is determined in the step S217 that the offset direction is backward, the CPU 311 causes the lateral registration-detecting sensor 104 to be shifted in the direction indicated by the arrow E2 and the shift unit 108 to be shifted in the direction indicated by the arrow J2 (step S205).

On the other hand, if it is determined that the offset direction is not backward, i.e. it is frontward, the CPU 311 causes the lateral registration-detecting sensor 104 to be shifted frontward without shifting the shift unit 108 (step S219).

If it is determined in the step S204 that the lateral registration-detecting sensor 104 is off, the CPU 311 determines whether or not the offset direction of the sheet is frontward (step S216). If it is determined in the step S216 that the offset direction is frontward, the CPU 311 causes the lateral registration-detecting sensor 104 to be shifted in the direction indicated by the arrow E1 in FIG. 10 and the shift unit 108 to be shifted in the direction indicated by the arrow J1 in FIG. 10 (step S209).

On the other hand, if it is determined that the offset direction is not frontward, i.e. it is backward, the CPU 311 causes the lateral registration-detecting sensor 104 to be shifted in the direction indicated by the arrow E1 without shifting the shift unit 108 (step S218).

In short, the CPU 311 functions as a shift stop unit configured to stop the shift of a sheet in a case where a direction in which the sheet is to be shifted so as to offset the sheet discharge position and a direction in which the sheet is to be shifted so as to measure the sheet edge position by the edge position measurement unit differ from each other.

Then, the CPU 311 executes a step S206 after the step S205 or S219, whereas after the step S209, it executes a step S210. Steps subsequent to the step S206 and the step S210 are the same as the step S106 et seq. and the step S110 et seq. in FIGS. 11A and 11B, respectively.

Advantageous effects of the present embodiment will be described with reference to FIGS. 13 and 14.

Figure 13:
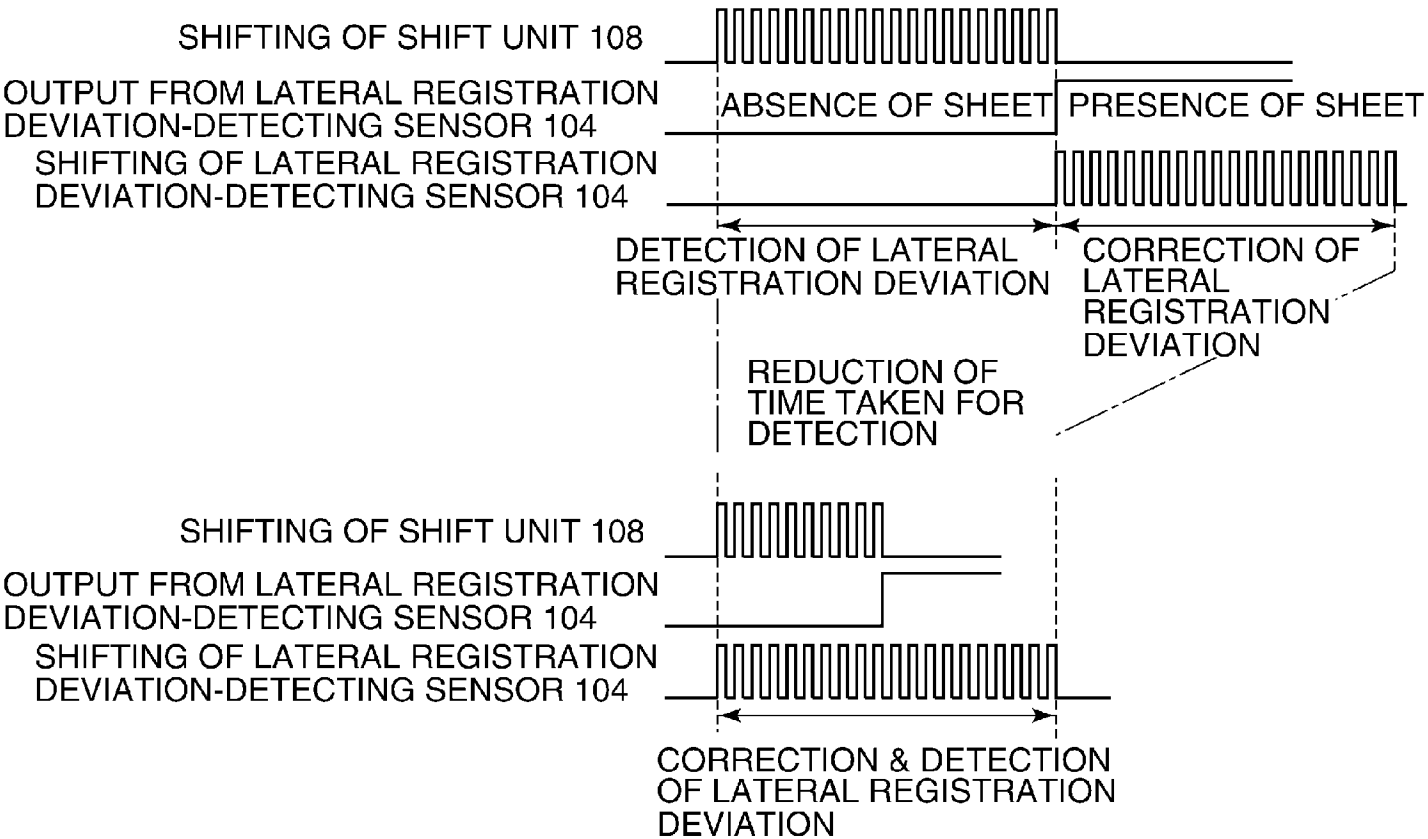
FIG. 13 is a timing diagram showing the relationship between the shift of the lateral registration deviation-detecting sensor unit, that of the shift unit, and states of detection by the lateral registration deviation-detecting sensor unit.

FIG. 13 is a timing diagram showing the relationship between the shifting of the lateral registration deviation-detecting sensor unit 104 appearing in FIG. 2, states of detection of a sheet by the lateral registration deviation-detecting sensor unit 104, and the shifting of the shift unit 108, with a horizontal axis representing time.

The upper part of the FIG. 13 timing diagram shows a conventional case where detection of the amount of lateral registration deviation and correction of the lateral registration deviation are performed separately (sequentially), while the lower part of the FIG. 13 timing diagram shows a case of the present embodiment where detection of the amount of lateral registration deviation and correction of the lateral registration deviation are performed in parallel.

As shown in FIG. 13, in the latter case, in detecting the amount of lateral registration deviation, by simultaneously performing the shifting of the sheet and the shifting of the lateral registration deviation-detecting sensor unit 104, it is possible to shorten a time period required for the detection of the amount of lateral registration deviation and the correction of the lateral registration deviation, and convey sheets at high speed.

Figure 14:
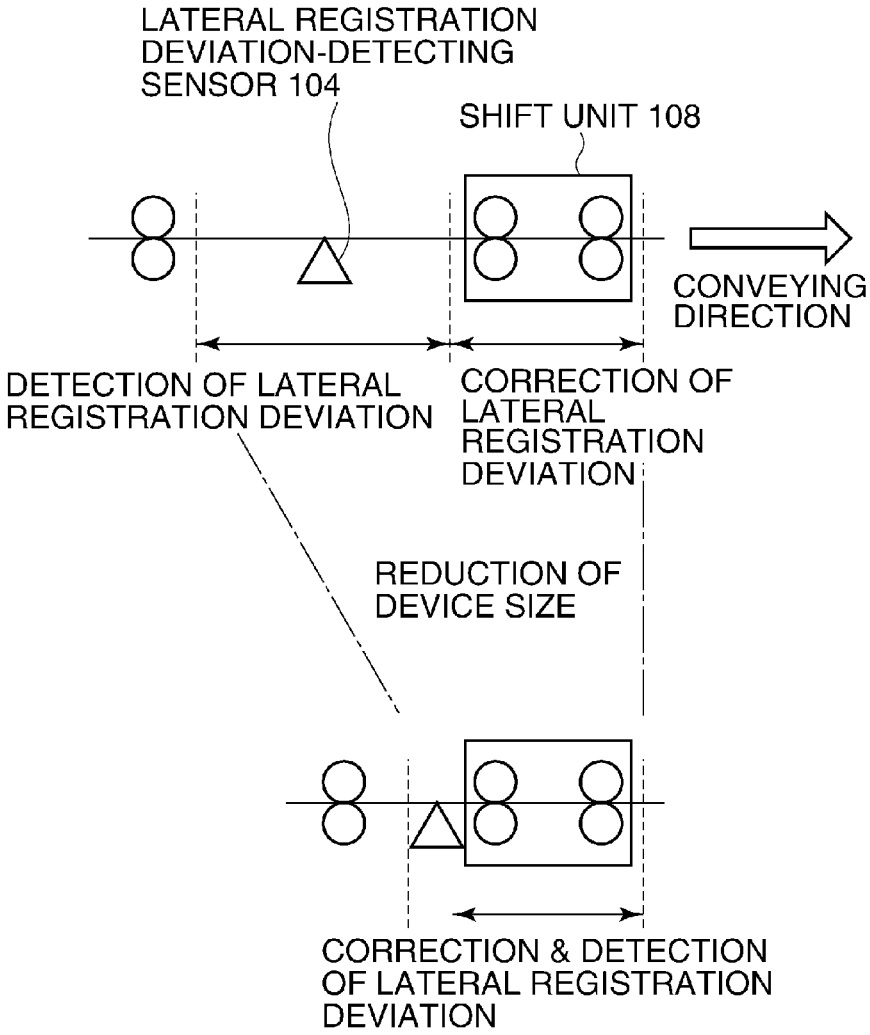
FIG. 14 is a view showing the positional relationship between the lateral registration deviation-detecting sensor unit and the shift unit.

FIG. 14 is a view showing the positional relationship between the lateral registration deviation-detecting sensor unit 104 and the shift unit 108.

The upper part of FIG. 14 shows conventional arrangement, while the lower part shows the arrangement of the present embodiment.

The parallel execution of detection of the amount of lateral registration deviation and correction of the lateral registration deviation makes it possible to arrange the lateral registration deviation-detecting sensor unit 104 for detecting the amount of lateral registration deviation and the shift unit 108 for correcting the lateral registration deviation, more closely to each other than in the prior art, which contributes to reduction of the size of the apparatus.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2008-144552 filed Jun. 2, 2008, which is hereby incorporated by reference herein in its entirety.

What is claimed is:

1. A sheet conveying device comprising:

a sheet conveying unit configured to convey a sheet in a sheet conveying direction;

a sheet shifting unit configured to shift a sheet conveyed by said sheet conveying unit, in a lateral direction, perpendicular to the sheet conveying direction;

a sheet detecting sensor configured to detect shifting of the sheet by said sheet shifting unit;

a sensor shifting unit configured to shift said sheet detecting sensor in the lateral direction; and a controller configured to:

control said sensor shifting unit and said sheet shifting unit so that said sheet detecting sensor and the sheet shift in respective opposite directions;

measure an edge position of the sheet based on an amount of shift of said sheet detecting sensor required for detecting the edge position of the sheet; and control said sheet shifting unit to shift the sheet, based on a result of the measurement, such that an edge of the sheet is aligned with a predetermined position in the lateral direction.

2. The sheet conveying device according to claim 1, wherein said controller controls said sensor shifting unit and said sheet shifting unit to shift said sheet detecting sensor and the sheet in the respective opposite directions, after said sheet conveying unit conveys the sheet to a position of said sheet detecting sensor.

3. The sheet conveying device according to claim 2, wherein:

if said sheet detecting sensor detects the sheet when said sheet conveying unit conveys the sheet to the position of said sheet detecting sensor, said controller controls said sensor shifting unit and said sheet shifting unit so that said sheet detecting sensor and the sheet shift away from each other in the opposite directions to make the sheet undetectable by said sheet detecting sensor, and if said sheet detecting sensor does not detect the sheet when said sheet conveying unit conveys the sheet to the position of said sheet detecting sensor, said controller controls said sensor shifting unit and said sheet shifting unit so that said sheet detecting sensor and the sheet shift toward each other in the opposite directions to make the sheet detectable by said sheet detecting sensor.

4. The sheet conveying device according to claim 1, wherein said controller is further configured to, in a case where the sheet conveying device operates in a sheet offset mode for offsetting a sheet discharge position in the lateral direction, control said sheet shifting unit so that a direction for offsetting the sheet and a direction for shifting the sheet for measurement of the edge position of the sheet are different from each other, to stop said sheet shifting unit from shifting the sheet for measurement of the edge position of the sheet.

5. The sheet conveying device according to claim 1, wherein said sheet detecting sensor is disposed upstream of said sheet shifting unit in the sheet conveying direction.

6. An image forming apparatus comprising:

an image forming section configured to form an image on a sheet;

a sheet conveying unit configured to convey a sheet on which the image is formed in a sheet conveying direction;

a sheet shifting unit configured to shift a sheet conveyed by said sheet conveying unit, in a lateral direction, perpendicular to the sheet conveying direction;

a sheet detecting sensor configured to detect shifting of the sheet by said sheet shifting unit;

a sensor shifting unit configured to shift said sheet detecting sensor in the lateral direction; and a controller configured to:

control said sensor shifting unit and said sheet shifting unit so that said sheet detecting sensor and the sheet shift in respective opposite directions measure an edge position of the sheet based on an amount of shift of said sheet detecting sensor required for detecting the edge position of the sheet; and control said sheet shifting unit to shift the sheet, based on a result of the measurement, such that an edge of the sheet is aligned with a predetermined position in the lateral direction.

* * * * *